US006462291B1

(12) United States Patent
Sachs

(10) Patent No.: US 6,462,291 B1
(45) Date of Patent: Oct. 8, 2002

(54) HOUSING PART WITH AN ACTUATING ELEMENT

(75) Inventor: Ekkehard Sachs, Spaichingen (DE)

(73) Assignee: Marquardt GmbH, Rietheim-Weitheim (DE)

( * ) Notice: Subject to any disclaimer, the term of this patent is extended or adjusted under 35 U.S.C. 154(b) by 0 days.

(21) Appl. No.: 09/674,294

(22) PCT Filed: Apr. 22, 1999

(86) PCT No.: PCT/DE99/01205

§ 371 (c)(1),
(2), (4) Date: Oct. 26, 2000

(87) PCT Pub. No.: WO99/55990

PCT Pub. Date: Nov. 4, 1999

(30) Foreign Application Priority Data

Apr. 28, 1998 (DE) ..... 198 18 920

(51) Int. Cl.[7] ..... H01H 9/04
(52) U.S. Cl. ..... 200/302.2; 200/341; 29/622
(58) Field of Search ..... 29/622; 200/5 R, 200/5 A, 293–298, 302.1–303, 341

(56) References Cited

U.S. PATENT DOCUMENTS

| | | | | |
|---|---|---|---|---|
| 4,402,131 | * | 9/1983 | Roberts | 29/622 |
| 4,520,247 | * | 5/1985 | Pancook et al. | 200/298 |
| 5,219,067 | | 6/1993 | Lima et al. | 200/302.2 |
| 5,260,532 | * | 11/1993 | Tinder et al. | 200/302.1 |
| 5,516,991 | * | 5/1996 | Hommann | 200/6 R |
| 5,746,307 | * | 5/1998 | Joss et al. | 200/303 |
| 6,093,900 | * | 7/2000 | Wisskirchen et al. | 200/302.2 |
| 6,246,019 | * | 6/2001 | Nakamura et al. | 200/6 A |

FOREIGN PATENT DOCUMENTS

| | | | |
|---|---|---|---|
| DE | 42 20 214 A1 | 1/1993 | H02B/1/16 |
| DE | 42 26 579 A1 | 2/1994 | E05B/19/00 |
| DE | 196 05 201 A1 | 8/1997 | E05B/49/00 |
| EP | 0 658 670 A1 | 6/1995 | E05B/19/04 |

* cited by examiner

*Primary Examiner*—Michael Friedhofer
(74) *Attorney, Agent, or Firm*—Morgan, Lewis & Bockius LLP

(57) ABSTRACT

A housing part (6) of plastic may be used for an electronic key (1) of a locking system in a motor vehicle. The housing part (6) has an actuating member (3, 4) for an electrical switch (10), the actuating member (3, 4) being designed in a manner of a surface (27, 27') which can be elastically deformed for the actuation and if appropriate extends essentially in the surface (26) of the housing part (6). The actuating member (3, 4) acts in an actuating manner on a plunger (12) or the like of the electrical switch (10). The actuating member (3, 4) is arranged on a rigid supporting element (13) which is essentially undeformable when the actuating member (3, 4) is actuated. Both the actuating member (3, 4) and the supporting element (13) are prefabricated as half-parts. The half-parts are encapsulated with the plastic of the housing part (6) in the production of the housing part (6) in such a way that the supporting element (13) is facing the electrical switch (10).

22 Claims, 11 Drawing Sheets

HOUSING PART WITH AN ACTUATING ELEMENT

BACKGROUND OF THE INVENTION

The invention relates to a housing part of plastic.

To increase convenience for the user, locking systems for motor vehicles are often equipped with an electronic key. After appropriate actuation by the user, a code is exchanged, for example by means of electromagnetic waves, between the key and the locking system, so that after positive evaluation of the code the doors and the trunk lid of the motor vehicle are unlocked or locked by remote control and other functions are initiated.

An electronic key of this type, which is known from DE 196 05 201 A1, has a housing of plastic. Arranged on a housing part are actuating members for electrical switches for the manual initiation of functions of the locking system. The electrical switch is arranged on a printed-circuit board located in the housing, the actuating member acting in an actuating manner on a plunger of the electrical switch via an opening in the housing part. The actuating member is designed in the manner of a surface which extends essentially in the surface of the housing part and can be elastically deformed for the actuation.

FIELD OF THE INVENTION

For sealing the housing against the ingress of contaminants in the region of the actuating members, an elastic sealing element which covers the opening in the sealing part is arranged between the actuating member and the electrical switch. The sealing element may be welded or else molded onto the edge of the opening in the housing part. The production of the additional sealing element is complicated and laborious.

SUMMARY OF THE INVENTION

The invention is based on the object of achieving a reliable sealing of the housing part in the region of the actuating member by simple means. In particular, the production of the housing part is to be simplified.

The invention is based on the basic idea of providing a supporting element for the actuating member, the supporting element and the actuating member being prefabricated as half-parts. In the production of the housing part taking place by injection molding, the two half-parts are encapsulated along at least a part of their edge with the plastic for the housing part. As a result, the actuating member together with the supporting element is embedded in the housing part in such a way that the actuating member itself serves for the sealing of the opening in the housing part and is nevertheless movable for the actuation of the electrical switch.

For simple handling in the production of the housing part, it is appropriate to provide for the actuating member on the supporting element a fastening of such a type that the two half-parts form a joint component for the encapsulation with the plastic of the housing part. The fastening may be produced by a force closure and/or a form fit.

For example, pegs, catch hooks, snap hooks or the like on one half-part may engage in corresponding receptacles on the other half-part. Furthermore, one of the half-parts, in particular the supporting element, may have through-holes. The through-holes are filled with plastic of the housing part during the encapsulation. This achieves a particularly good anchorage of the supporting element together with the actuating member in the housing part.

For the actuating action on the plunger of the electrical switch, the actuating member is assigned an attachment which is movable in the direction of the electrical switch. This attachment may be arranged in the manner of a peg approximately in the center of the actuating member on the side facing the supporting element. In the supporting element there is an opening which corresponds to the attachment and into which the attachment protrudes to act on the plunger.

In an embodiment which may be appropriate when using a soft-elastic material for the actuating member, the attachment is formed in one piece with the actuating member. For this purpose, the attachment is molded onto the actuating member in the production of the half-part. In another embodiment, which may be appropriate in particular when using a hard-elastic material for the actuating member, the attachment comprises a part which is separate from the actuating member, the actuating member bearing against the attachment with a part of its side facing the electrical switch. The attachment is expediently arranged by means of a spring-like element at the opening in the supporting element. The spring-like element may be designed in the manner of a torsion spring of plastic, the spring-like element being molded in one piece onto the opening in the supporting element on the one hand and onto the attachment on the other hand.

If the supporting element is designed for simultaneously receiving a plurality of actuating members, the production of a housing part with a plurality of actuating members can be simplified. The actuating members are fastened as individual half-parts on this supporting element to form a component. Equally well, a plurality of actuating members may also be formed as a one-piece half-part, which is then fastened on the supporting element, with a component in turn being formed. For the encapsulation with the plastic of the housing part, only this one component then has to be handled. The actuating member may be designed as an elongate part with rounded-off corners and/or rounded-off sides, as an oval part, as a round part or as a circular part or may have some other desired shape. The supporting element has in turn a shape corresponding approximately to the actuating member or to the actuating members.

In a development, the supporting element is designed in the manner of an essentially planar plate and the actuating member is designed in the manner of an elastically deformable membrane, if appropriate having a curvature. The elasticity of the membrane is then fixed by its thickness in dependence on the hardness of the plastic. Suitable as the plastic for the actuating member is on the one hand a soft, elastic plastic, such as a thermoplastic elastomer. In particular, the thermoplastic elastomer may be a block copolymer of polybutylene terephthalate and polyether glycol. On the other hand, a hard plastic, such as polyamide, polyacetal or the like, is also suitable for the actuating member. The housing part consists of a hard plastic, for example of polyamide, which may be glass-fiber filled or glass-bead filled.

The supporting element expediently likewise consists of a hard plastic. It may be appropriate to use a plastic which is largely transparent to light in at least a partial range of the visible spectrum, such as polycarbonate, transparent amorphous polyamide or the like. In this case, a lighting element can be integrated in the housing part in a particularly simple way. For this purpose, a portion of an approximately lenticular or cylindrical form may be arranged on the supporting element in one piece via a carrier part. This portion is then encapsulated with the plastic of the housing part in such a way that the portion forms a window molded into the wall of the housing part.

In the invention, the actuating member itself serves as the sealing means, so that it is possible to dispense with an additional sealing element. Nevertheless, reliable sealing of the housing is achieved in the region of the actuating members, whereby a functionally reliable electronic key is obtained.

Since there is no need for an additional sealing element, which is difficult to produce or process, the production of the housing part according to the invention is simplified. As a result, cost savings are in turn achieved. In particular, the supporting element has the effect of dimensionally stabilizing the actuating member, which in itself as an individual part is flaccid, and, as a result, is easier to handle when placing into the injection mold during the production of the housing part.

Further advantages achieved by the invention are, in particular, that there is great freedom in the choice of materials for the housing part and the actuating member. In the case of the previously known housing part, only certain material combinations are possible on account of the necessary production conditions and they do not allow, for example, a free choice of colors for the actuating members. The actuating members of the housing part according to the invention can advantageously be colored as desired. Furthermore, printing the desired symbols onto the actuating members or laser inscription of the actuating members is possible. The use of partially transparent materials for the actuating members allows them to be designed such that they can be illuminated with functional and/or search lighting. It is plainly evident that a multitude of design possibilities for the electronic key have now been opened up.

BRIEF DESCRIPTION OF THE DRAWINGS

Exemplary embodiments of the invention are described in more detail below and are represented in the drawings, in which.

DETAILED DESCRIPTION OF THE PREFERRED EMBODIMENTS

Figure 1:
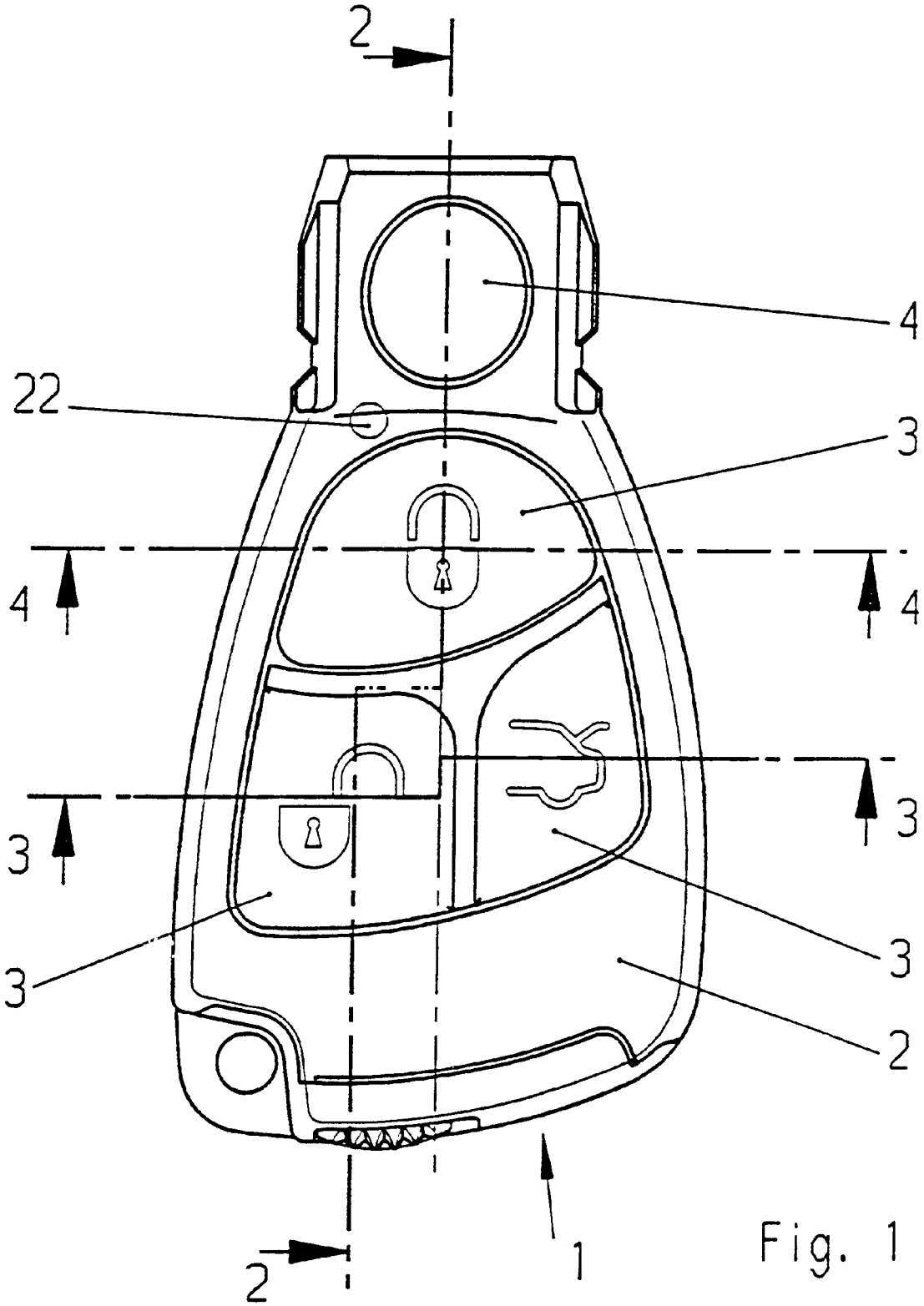
FIG. 1 shows an electronic key in plan view.

Shown in FIG. 1 is an electronic key 1 for a locking system of a motor vehicle. The electronic key 1 has a housing 2, on which a plurality of actuating members 3, 4 for the remote-controllable initiation of functions of the locking system are arranged. For example, by manual actuation of the actuating members 3, the central locking can be locked or unlocked and the trunk lid can be opened. The symbols corresponding to these functions have been applied to the actuating members 3. A further actuating member 4 serves for example for setting off an alarm. The housing 2 has an asymmetrically wedge-like shape, which can be handled particularly ergonomically by the user.

The housing 2 consists of a hard plastic, such as for example polyamide, glass-fiber filled or glass-bead filled polyamide or the like, and is produced by the injection molding process. As FIG. 2 reveals in more detail, the housing 2 is essentially made up of a housing part 6, designed in the manner of a base, and a housing part 5, designed in the manner of a cover, the housing interior 31 in the housing part 6 being closed by the housing part 5. In the housing interior 31 there is arranged a printed-circuit board 7 for receiving the electronic and electrical components 8 required for the functions of the electronic key 1. Also located in the housing interior 31 is the battery 9, serving for supplying the voltage to the electronic key 1. Finally, electrical switches 10 assigned to the actuating members 3, 4 are located on the printed-circuit board 7.

The actuating members 3, 4 for the electrical switches 10 are arranged on the housing part 6. For reasons of ergonomics and ease of handling of the electronic key 1, the actuating member 3, 4 is preferably designed in the manner of a surface 27 extending essentially in the surface 26 of the housing part 6. If the user presses the actuating member 3, 4, it is deformed elastically by the pressure exerted. In this case, the actuating member 3, 4 acts on a plunger 12 or some other actuating element of the electrical switch 10 for the actuation of the switch 10 until the user releases the actuating member 3, 4 again.

Figure 7:
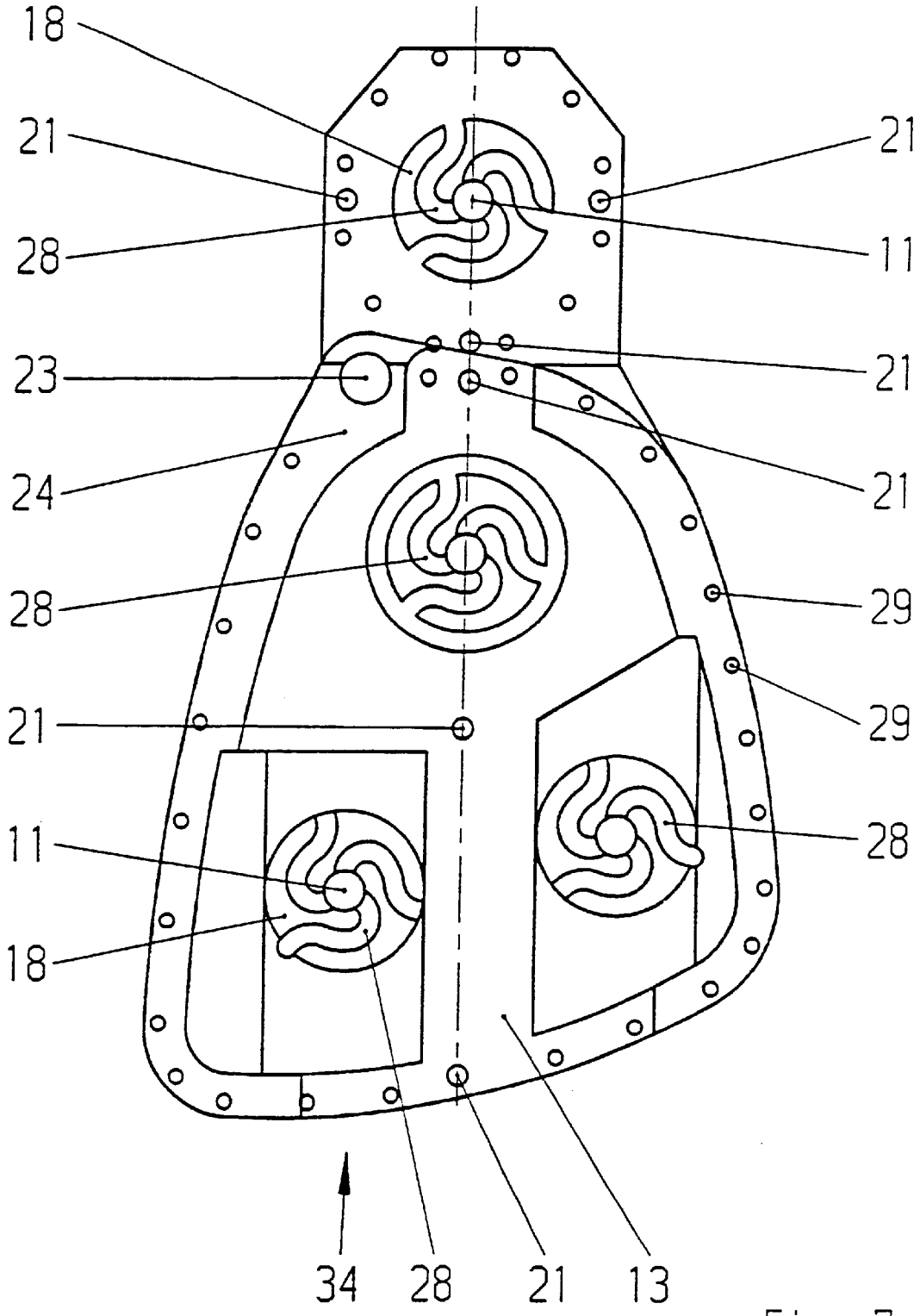
FIG. 7 shows a plan view of the supporting element as a half-part.
Figure 8:
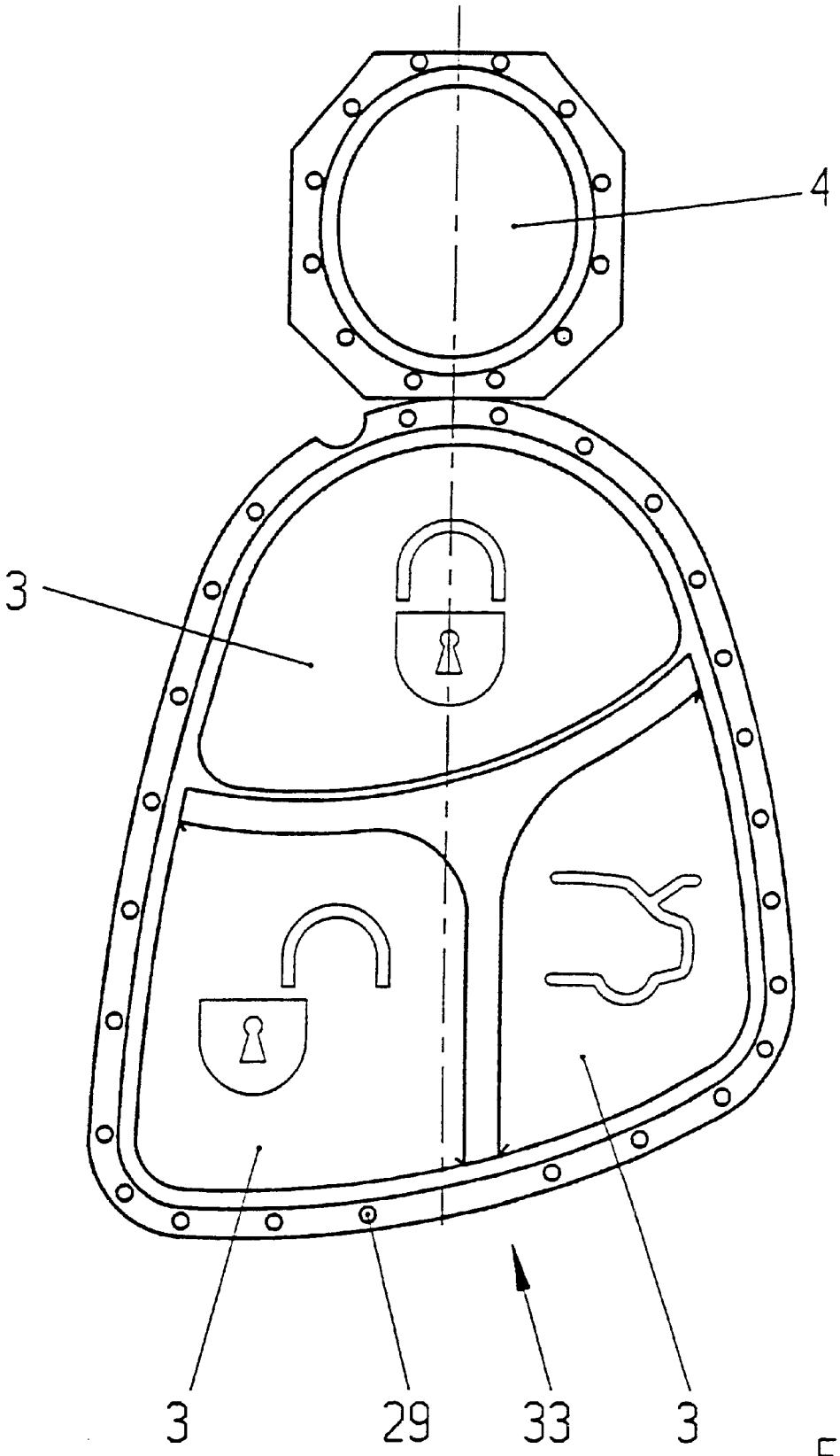
FIG. 8 shows a plan view of the actuating members as a half-part.

The actuating member 3, 4 is arranged on a rigid supporting element 13, which is essentially undeformable when the actuating member 3, 4 is actuated. The supporting element 13 preferably consists of a hard plastic, it being possible to use a polyamide or the like. Both the actuating member 3, 4 and the supporting element 13 are prefabricated as half-parts 33, 34, which are shown in FIGS. 7 and 8. These half-parts 33, 34 are embedded into the housing part 6 at an opening 14 of the housing part 6, the embedding 37 extending essentially all around the edge of the opening 14 and along at least a part of the edge of the half-parts 33, 34, as revealed in more detail by FIGS. 3 and 4. For this purpose, the half-parts 33, 34 are encapsulated at the edge region with the plastic of the housing part 6 in the production of the housing part 6 in such a way that the supporting element 13 is facing the electrical switch 10. As further revealed, the encapsulated edge of the half-parts 33, 34 is embedded in the housing part 6 such that the supporting element 13 is located on the side 15 of the housing part 6 situated closer to the electrical switch 10 and the actuating member 3, 4 is located on the side 16 of the housing part 6 located away from the electrical switch 10. Consequently, the embedding 37 of the actuating member 3, 4, running essentially continuously all around the opening 14, advantageously has the effect of achieving a sealing of the housing part 6 at the opening 14.

It is preferred to design the surface 27 for the actuating member 3, 4, extending essentially in the surface 26 of the housing part 6, in the manner of an elastically deformable membrane. If it is desired for ergonomic reasons, the membrane may also have a curvature, as is likewise shown in FIG. 2 by the surfaces 27', so that the membrane protrudes somewhat above the surface 26. The actuating member 3, 4 or the membrane consists of plastic. The elasticity of the membrane is fixed by its thickness in dependence on the hardness of the plastic. Consequently, the membrane is deformed elastically under the manual action of the user and thereby acts on the plunger 12. On the other hand, the supporting element 13, likewise consisting of plastic, is of a rigid design in the manner of an essentially planar plate, as is shown in FIG. 7. As a result, the supporting element 13 also stiffens the housing 2 in the region of the opening 14.

In a further refinement, the actuating member 3, 4 is assigned an attachment 11, which is movable in the direction of the electrical switch 10. It can be seen from FIG. 2 that the attachment 11 is arranged in the manner of a peg approximately in the center of the actuating member 3, 4 on the side 17 facing the supporting element 13. Located in the supporting element 13 is an opening 18 which corresponds to the attachment 11 and into which the attachment 11 protrudes. When the user acts manually on the actuating member 3, 4, the attachment 11 consequently passes through the opening 18 and ultimately actuates the plunger 12 of the electrical switch 10.

Figure 5:
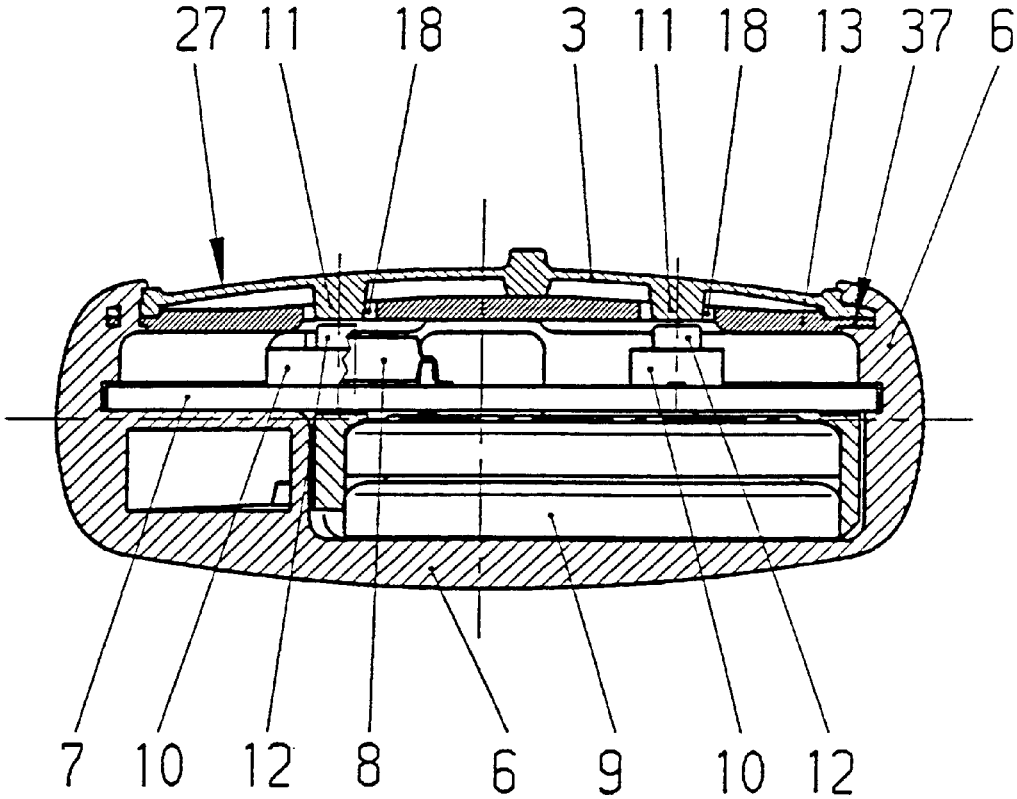
FIG. 5 shows a section as in FIG. 3 corresponding to a further exemplary embodiment.
Figure 6:
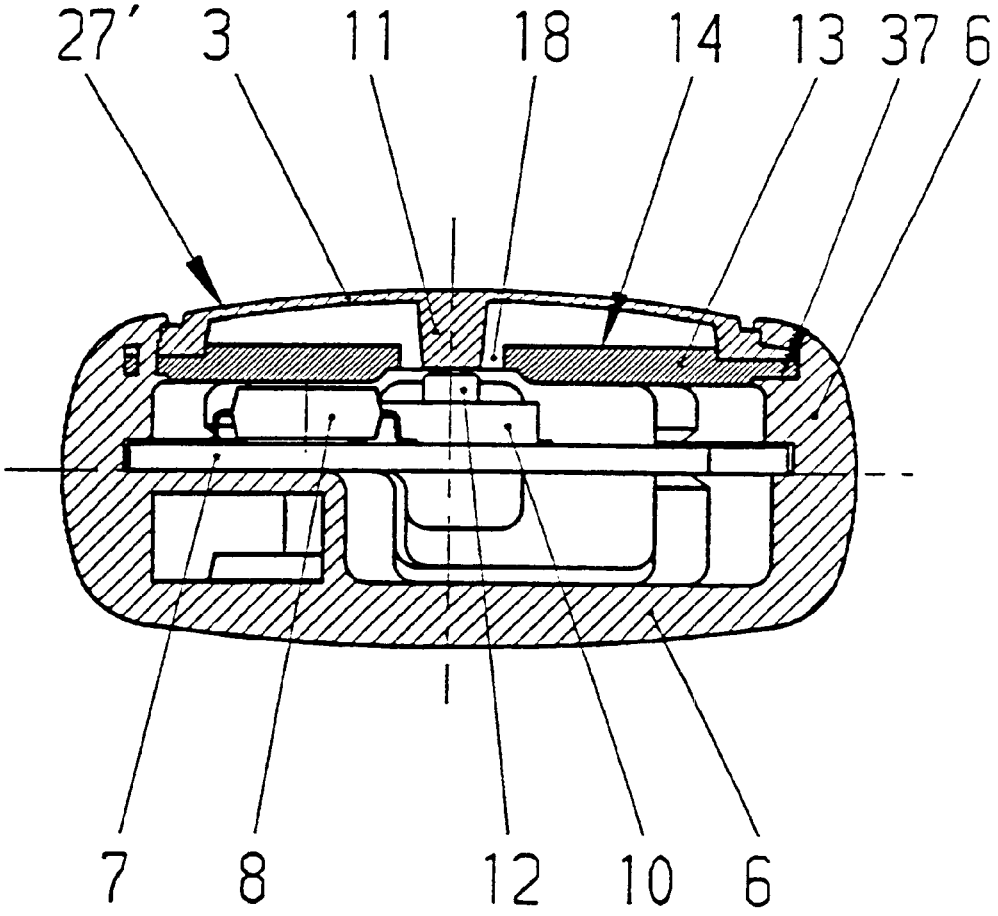
FIG. 6 shows a section as in FIG. 4 corresponding to the further exemplary embodiment.

In a first embodiment of the invention, which can be seen in FIGS. 5 and 6, the attachment 11 is formed in one piece with the actuating member 3, 4. For this purpose, the attachment 11 is integrally molded onto the actuating member 3, 4, to be precise approximately centrally. In the case of such a design it may be appropriate to choose a soft, elastic plastic as the material for the actuating member 3, 4 in the form of a membrane. For example, a thermoplastic elastomer, such as a block copolymer comprising polybutylene terephthalate and polyether glycol, is suitable as the plastic for the actuating member 3, 4.

Figure 2:
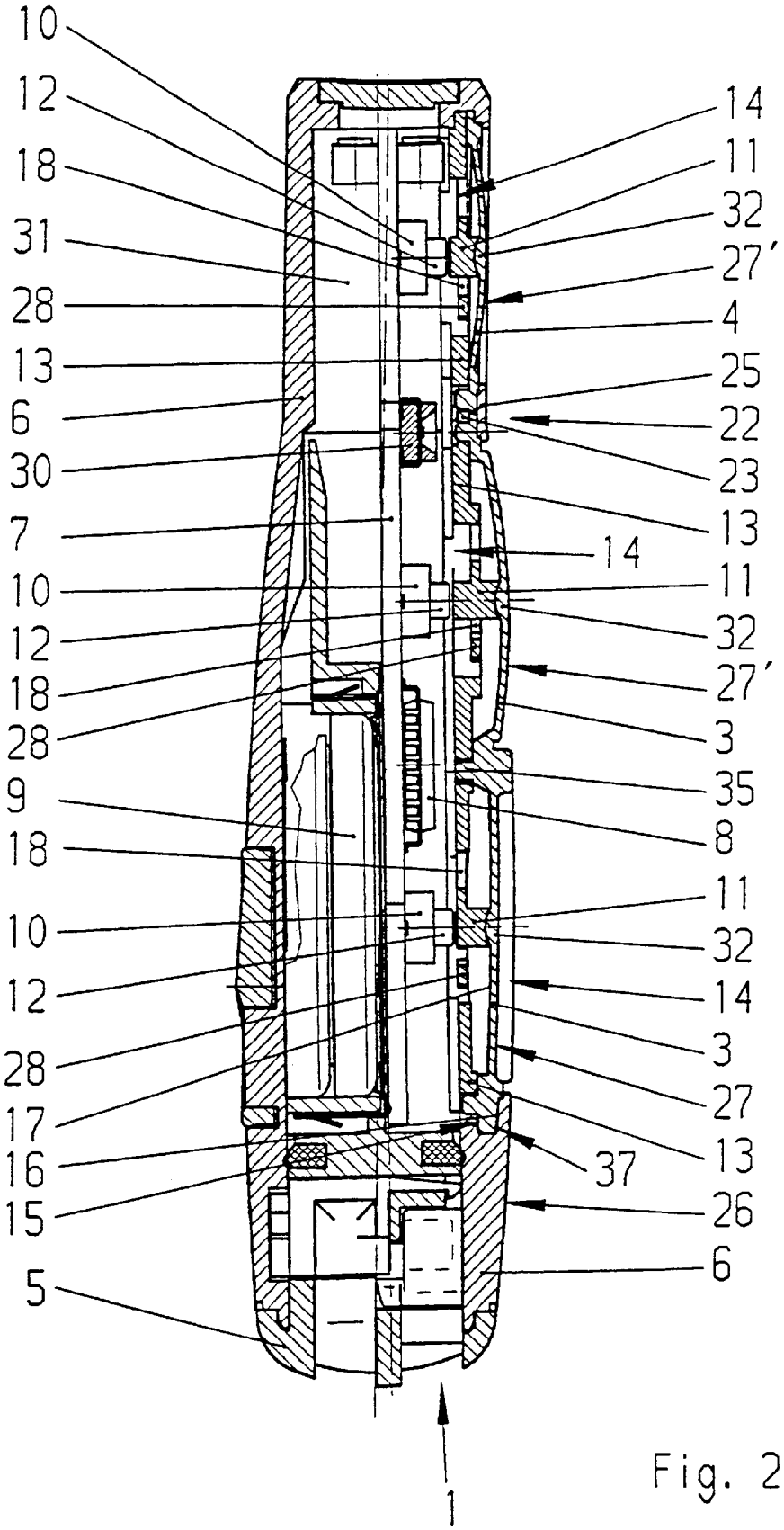
FIG. 2 shows a section along the line II—II from FIG. 1.
Figure 3:
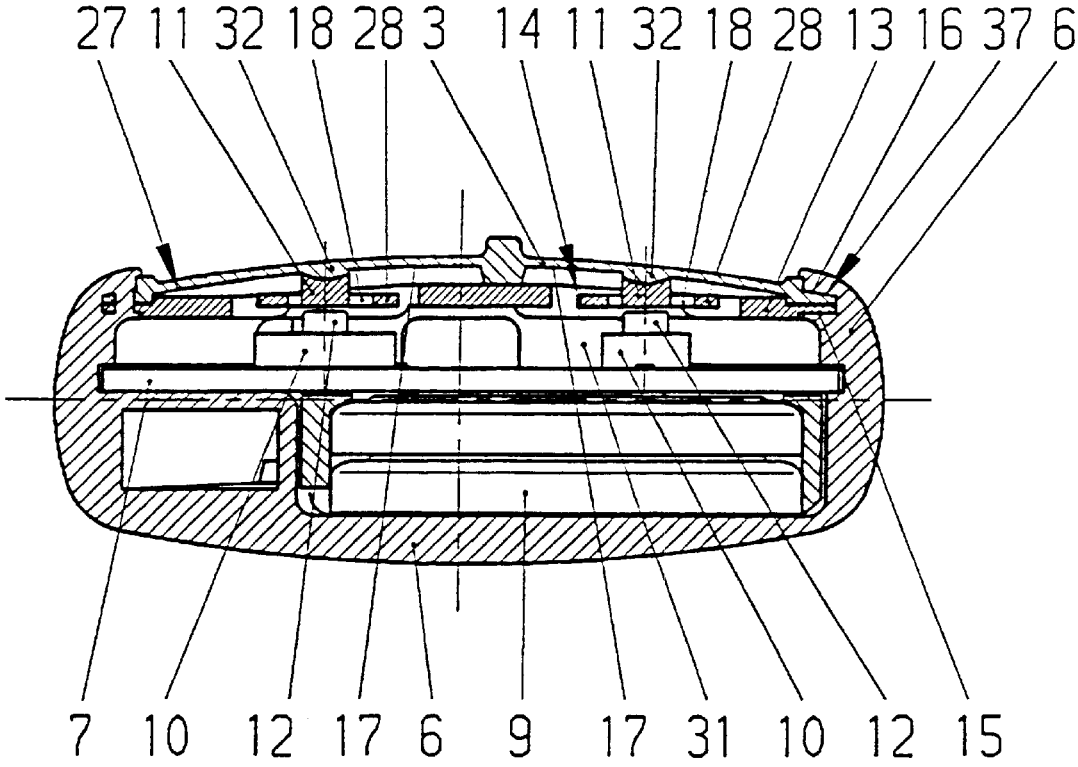
FIG. 3 shows a section along the line III—III from FIG. 1.
Figure 4:
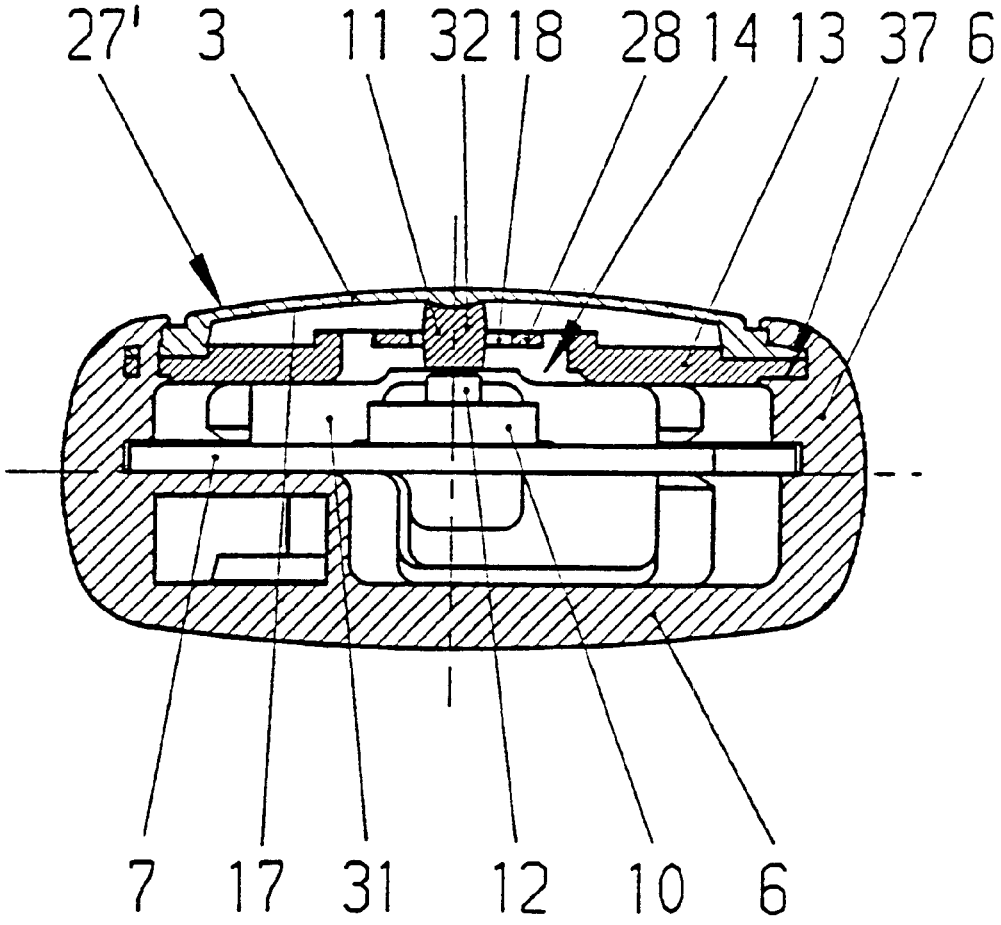
FIG. 4 shows a section along the line IV—IV from FIG. 1.

In a second embodiment, which is shown in FIGS. 2 to 4, the attachment 11 comprises a part which is separate from the actuating member 3, 4. The actuating member 3, 4 in the form of a membrane bears against the attachment 11 with a part 32 of the side 17 which is facing the electrical switch 10. The attachment 11 is in turn arranged by means of a spring-like element 28 at the opening 18 in the supporting element 13, whereby the attachment 11 can be moved with a restoring force in the direction of the plunger 12 of the switch 10. For example, the spring-like element 28 may be formed in the manner of a torsion spring of plastic, as FIG. 7 reveals. The spring-like element 28 is expediently molded in one piece onto the edge of the opening 18 in the supporting element 13 on the one hand and onto the attachment 11 on the other hand. In the case of a design of this type, it may be appropriate to choose a hard plastic, such as polyamide, polyacetal or the like, as the material for the actuating member 3, 4 in the form of a membrane. As already stated, the elasticity of the actuating member 3, 4 in the form of a membrane is then set by the thickness of the membrane.

In the embedding in the housing part 6, the two half-parts 33, 34 bear against one another at an edge region. To simplify the production of the housing part 6, the actuating member 3, 4 may be designed such that it can be fastened on the supporting element 13, whereby the two half-parts 33, 34 form a joint component 19, shown in FIGS. 10 and 11. The fastening is expediently produced by a force closure and/or form fit between the two half-parts 33, 34.

Figure 9:
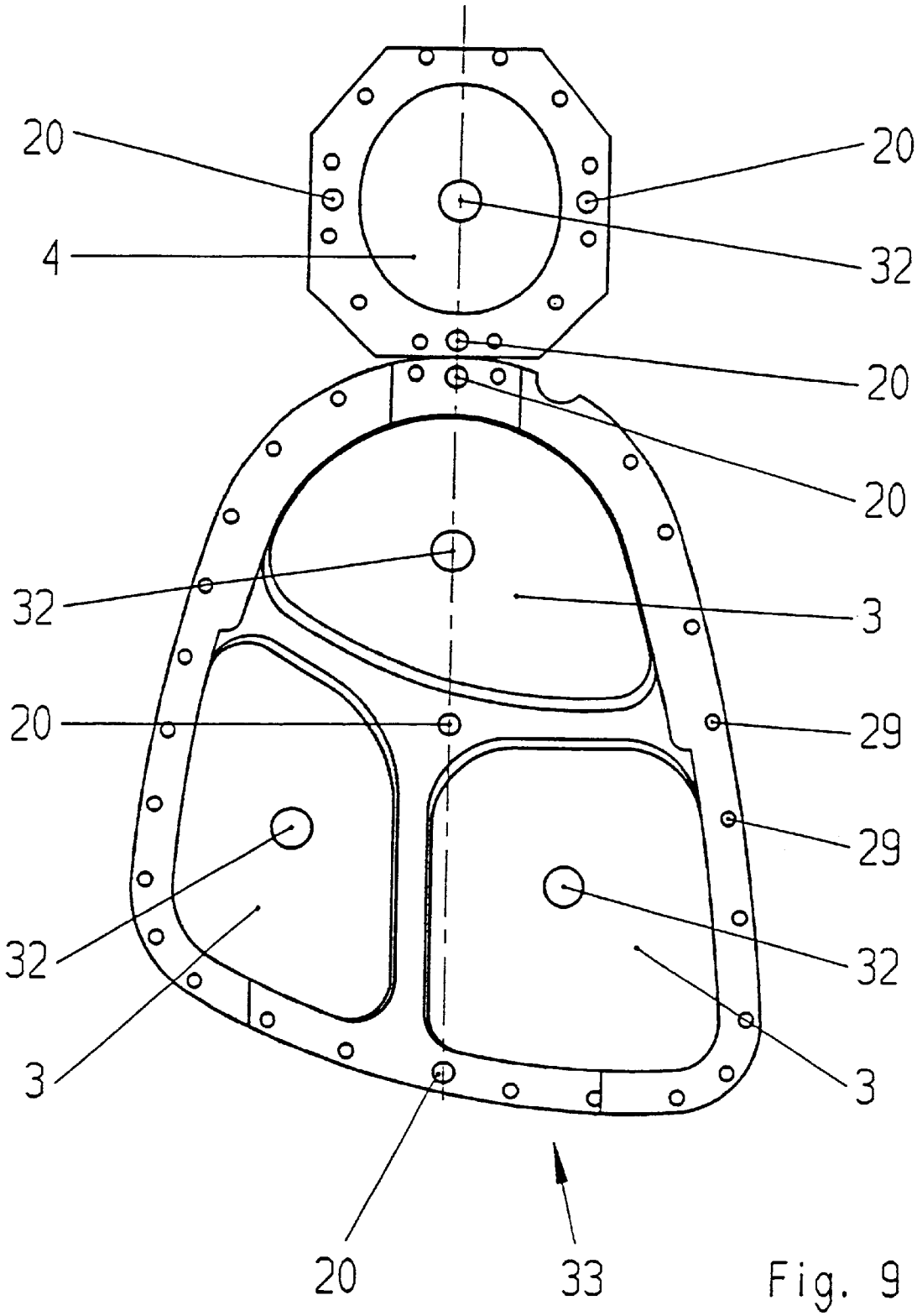
FIG. 9 shows a view from the underside of the half-part from FIG. 8.
Figure 10:
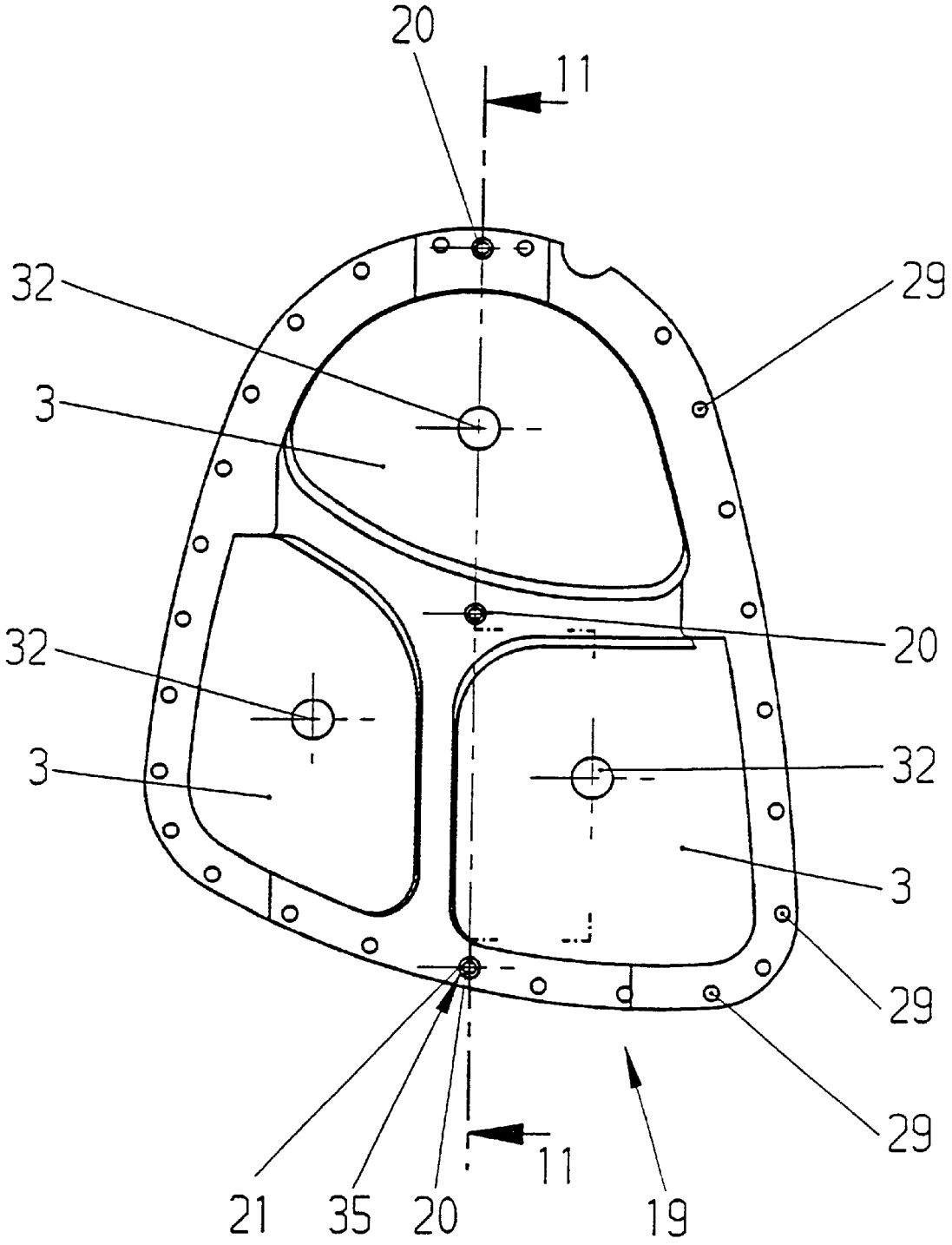
FIG. 10 shows a view from the underside of the supporting element and the actuating members as a joint component and FIG. 11 shows a section along the line 11—11 from FIG. 10.
Figure 11:
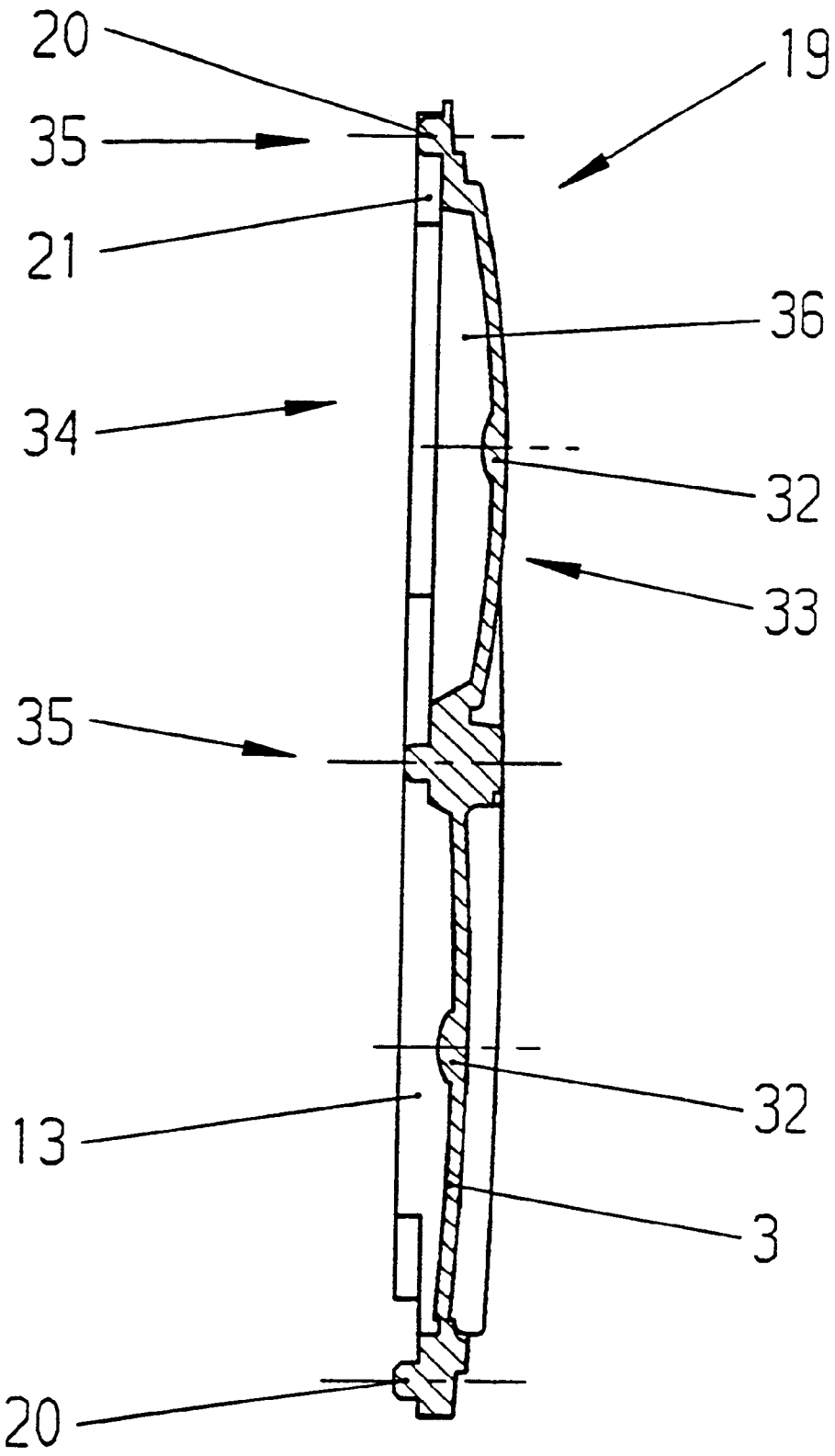

An example of a force-closure and/or form-fit connection of this type can be seen in FIGS. 7 and 9, where pegs 20 are attached, expediently in a distributed manner, at the periphery or at some other suitable points of the one half-part 33, to be specific on the actuating member 3, 4. The other half-part 34, to be specific the supporting element 13, then has for its part corresponding receptacles 21. The actuating member 3, 4 is fitted onto the supporting element 13 in such a way that the pegs 20 on the one half-part 33 engage in the receptacles 21 on the other half-part 34, which is indicated in FIGS. 10 and 11 by the peg-receptacle connections 35. It goes without saying that the pegs 20 may also be arranged on the supporting element 3 and the receptacles 21 may be arranged on the actuating member 3, 4. Instead of pegs 20, catch hooks, snap hooks or the like can also be used.

The component 19 is subsequently encapsulated along part of its edge with the plastic of the housing part 6, so that the component 19 is embedded in the housing part 6. It must be emphasized that a sealing of the housing part 6 is achieved as a result in the region of the actuating members 3, 4, so that the ingress of contaminants into the housing 2 is avoided. Further improvements can be additionally achieved by providing through-holes 29 on at least one half-part 33, 34, to be precise at the edge of the supporting element 13 and/or at the edge of the actuating member 3, 4. The through-holes 29 are filled with plastic of the housing part 6 during the encapsulation of the component 19, whereby an additional anchorage of the supporting element 13 and/or of the actuating member 3, 4 in the housing part 6 is brought about.

As can be seen from FIG. 1, the actuating members 3, 4 have an expedient form, adapted to the housing 2 and ergonomically shaped. For instance, the actuating member 3 is designed as an elongate part with rounded-off corners. The sides of this part may also be rounded-off. The further actuating member 4 is designed as a round, approximately circular part. If desired, the actuating member 4 may also have an oval shape. The supporting element 13 has a shape essentially corresponding to the form of the actuating members 3, 4, as FIG. 7 reveals. It may also be appropriate to design the supporting element 13 for receiving a plurality of actuating members 3, 4, as FIG. 7 likewise reveals. The supporting element 13 then comprises a single plate, with a plurality of actuating members 3, 4 being fastened on this plate. The actuating members may be designed in each case as individual, separate half-parts, which can be seen from the actuating member 4 in FIG. 8. On the other hand, a plurality of actuating members may also be designed as a one-piece half-part, which can be clearly seen from the actuating members 3 in FIG. 10. In FIGS. 10 and 11, the actuating member 4 and the associated part of the supporting element 13 have been omitted.

As can also be seen from FIG. 1, on the housing 2 there may also be arranged a window 22, which is assigned a light-emitting diode 30 which is on the printed-circuit board 7, can be seen in FIG. 2 and serves as a functional indicator for the key 1. It may then be appropriate to form the window 22 jointly with the half-part 34, as is shown in more detail in FIG. 7. For this purpose, a portion 23 of an approximately lenticular or cylindrical form or some other expedient shape is arranged on the supporting element 13. The portion 23 is connected in one piece to the supporting element 13 via a carrier part 24. Altogether, the supporting element 13 together with the portion 23 is produced from a plastic which is largely transparent to light in at least a partial range of the visible spectrum, which is determined by the radiation emitted by the light-emitting diode 30. Suitable as the plastic for the supporting element 13 in this case is, for example, polycarbonate, transparent amorphous polyamide or the like. During the encapsulation of the component 15, the portion 23 is then at the same time encapsulated with the plastic of the housing part 6 in such a way that the portion 23 forms a window 22 molded in the wall 25 of the housing part 6, as can be seen in FIG. 2.

A preferred process for producing the housing part 6 consequently proceeds as follows. Firstly, the actuating member 3, 4 and the supporting element 13 are prefabricated as half-parts 33, 34 from the respectively expedient plastic in a way known per se. Subsequently, the half-parts 33, 34 are arranged and/or fastened against one another to form a component 19. The component 19 is introduced into the injection mold for the housing part 6. It is introduced in such a way that the supporting element 13 largely seals the cavity 36 in the injection mold, said cavity being clearly visible in FIG. 11, located between the actuating member 3, 4 and the supporting element 13 and required for the deforming of the surface 27, 27 of the actuating member 3, 4 for the actuation of the switch 10. Subsequently, the plastic for the housing part 6 is then injected into the injection mold, the supporting element 13 preventing the plastic from penetrating into the cavity 36. Taking place at the same time as the injection molding of the housing part 6 is the encapsulation of the component 19 along at least a part of its edge with the plastic for the housing part 6, after which the component 19 is embedded at its edge in the housing part 6.

The invention is described in the above exemplary embodiments on the basis of a housing part which is used as a housing for an electronic key. It goes without saying that the invention is not restricted to this preferred use or to the exemplary embodiments described and presented. Rather, it also comprises all developments which can be carried out by a person skilled in the art within the scope of the idea of the invention. For instance, a housing part according to the invention may also be used on a remote control for television or audio equipment, on keyboards, on operating panels in motor vehicles and on domestic appliances or the like.

I claim:

1. A housing part made of plastic for an electronic key of a locking system of a motor vehicle comprising:

a fastening member for an electrical switch, and an actuating member acting on the electrical switch by way of a plunger, wherein the actuating member includes a surface which can be elastically deformed for actuation, and extends over at least part of a surface of the housing part, and the actuating member is arranged on a rigid supporting element which is substantially undeformable when the actuating member is actuated, and the actuating member and the supporting element are prefabricated as half-parts, the half-parts having edges and being encapsulated along at least a part of the edges with the plastic of the housing part during production of the housing part in a way that the supporting element is facing the electrical switch.

2. The housing part according to claim 1, wherein the edges of the half-parts are encapsulated by the plastic of the housing part and are embedded in the housing part in a way that the supporting element is located on a first side of the housing part situated closer to the electrical switch and the actuating member is located on a second side of the housing part located away from the electrical switch.

3. The housing part according to claim 1, wherein:

the half-parts bear against one another at an edge region, with the actuating member capable of being fastened on the supporting element in a way that the two half-parts form a joint component which is encapsulated along at least a part of a joint component edge with the plastic of the housing part, the fastening is produced by at least one of a force closure, a form fit, pegs, catch hooks and snap hooks on the actuating member, where one of the half-parts engages corresponding receptacles on the other half part, and at least one of the half-parts has through-holes which are filled with plastic of the housing part during the encapsulation in a way that an additional anchorage of at least the one of the half-parts in the housing part is brought about.

4. The housing part according to claim 1, wherein the actuating member is assigned an attachment which is movable in a direction of the electrical switch for actuation on the plunger of the electrical switch, the attachment is arranged in a manner of a peg approximately in a center of the actuating member on a side facing the supporting element, and an opening which corresponds to the attachment and into which the attachment protrudes is arranged in the supporting element.

5. The housing part according to claim 4, wherein the attachment is formed in one piece with the actuating member.

6. The housing part according to claim 4, wherein the attachment is integrally molded onto the actuating member.

7. The housing part according to claim 4, wherein the attachment comprises:

a part which is separate from the actuating member, the actuating member bearing against the attachment with a part of a side facing the electrical switch, the attachment being arranged by means of a spring-like element at the opening in the supporting element, and the spring-like element comprises a plastic torsion spring, and the spring-like element is molded, in one piece onto the opening in the supporting element and onto the attachment.

8. The housing part according to claim 1, wherein:

the supporting element is designed for receiving a plurality of actuating members, a plurality of actuating members being designed as a one-piece half-part or the actuating members being designed as individual half-parts, and the actuating member comprises at least one of an elongate part with rounded-off corners or rounded-off sides and the supporting element has a shape corresponding approximately to the actuating member.

9. The housing part according to claim 1, wherein the supporting element comprises an essentially planar plate, and the actuating member comprises an elastically deformable membrane having a curvature and a thickness, wherein the elasticity of the membrane is fixed by its thickness in dependence on a hardness of the plastic.

10. The housing part according to claim 1, wherein the actuating member comprises a soft, elastic plastic.

11. The housing part according to claim 1, wherein the housing part comprises a hard plastic.

12. The housing part according to claim 1, wherein the housing part comprises a glass fiber filled polyamide.

13. The housing part according to claim 1, wherein the housing part comprises a glass-bead filled polyamide.

14. The housing part according to claim 1, wherein the actuating member comprises a thermoplastic elastomer.

15. The housing part according to claim 1, wherein the actuating member comprises a block copolymer of polybutylene terephthalate and polyether glycol.

16. The housing part according to claim 1, wherein the actuating member comprises a hard plastic.

17. The housing part according to claim 1, wherein the actuating member comprises a polyamide.

18. The housing part according to claim 1, wherein the actuating member comprises polyacetal.

19. The housing part according to claim 1, wherein:

the supporting element comprises a hard plastic which is largely transparent to light in at least a partial range of the visible spectrum and a portion of an approximately lenticular form is arranged on the supporting element, the portion being encapsulated with the plastic of the housing part in such a way that the portion forms a window molded into the wall of the housing part.

20. The housing part according to claim 1, wherein the supporting element comprises a hard plastic which is largely transparent to light in at least a partial range of the visible spectrum, and a portion of an approximately cylindrical form is preferably arranged on the supporting element, the portion being encapsulated with the plastic of the housing part in such a way that the portion forms a window molded into a wall of the housing part.

21. The housing part according to claim 1, wherein a window is molded into a wall of the housing part.

22. A process for producing a plastic housing part for an electronic key of a motor vehicle locking system, comprising:

prefabricating from plastic an actuating member and a supporting element as half-parts;

arranging the actuating member and the supporting element together to form a component having an edge;

introducing the component into an injection mold for a housing part such that the supporting element substantially seals a cavity located between the actuating member and the supporting element, the cavity accommodating actuation of the actuation member; and encapsulating the component along at least a part of the edge of the component with plastic of the housing part during molding of the housing part.

* * * * *